US009016495B2

(12) United States Patent
Norton

(10) Patent No.: US 9,016,495 B2
(45) Date of Patent: Apr. 28, 2015

(54) CONVENIENCE TRASH BAG

(75) Inventor: Gary William Norton, Livermore, CA (US)

(73) Assignee: Gary W Norton, Livermore, CA (US)

( * ) Notice: Subject to any disclaimer, the term of this patent is extended or adjusted under 35 U.S.C. 154(b) by 622 days.

(21) Appl. No.: 13/066,799

(22) Filed: Apr. 26, 2011

(65) Prior Publication Data

US 2012/0273486 A1 Nov. 1, 2012

(51) Int. Cl.

| | |
|---|---|
| ***B65D 21/02*** | (2006.01) |
| ***B65D 25/20*** | (2006.01) |
| ***B65D 33/00*** | (2006.01) |

(52) U.S. Cl.

CPC ..... *B65D 25/20* (2013.01); *B65D 33/00* (2013.01); *B65D 2209/00* (2013.01)

(58) Field of Classification Search

CPC ..... B65D 33/00; B65D 25/20; B65D 2209/00

USPC ..... 220/23.83, 23.86, 23.87, 23.89, 908, 220/23.9, 495.01; 229/117.14, 117.27

See application file for complete search history.

(56) References Cited

U.S. PATENT DOCUMENTS

| | | | | |
|---|---|---|---|---|
| 4,098,398 | A * | 7/1978 | Meyers | 206/223 |
| 5,137,210 | A * | 8/1992 | Hibbs | 229/120.18 |
| 5,540,333 | A * | 7/1996 | Gonzalez et al. | 206/541 |
| 7,036,675 | B2 * | 5/2006 | Forest | 220/495.07 |
| 7,758,243 | B2 | 7/2010 | Bonke | 383/75 |
| D628,758 | S | 12/2010 | Stone | D34/5 |
| 7,946,422 | B1 * | 5/2011 | Bjerke | 206/546 |
| 2002/0100758 | A1 * | 8/2002 | Pyles | 220/495.07 |
| 2002/0175094 | A1 * | 11/2002 | Campbell et al. | 206/233 |
| 2004/0074955 | A1 * | 4/2004 | McKenna et al. | 229/125.08 |
| 2010/0282755 | A1 | 11/2010 | Kim | 220/495.07 |

* cited by examiner

*Primary Examiner* — Robert J Hicks
*Assistant Examiner* — Kareen Rush

(57) ABSTRACT

A trash storage method for a package of goods which attaches a layer of material to a package thereby providing a volume for storing trash generated from the goods as the goods are removed from the package and consumed or used.

2 Claims, 2 Drawing Sheets

CONVENIENCE TRASH BAG

FIELD OF INVENTION

This invention relates generally to the field of trash containers. More particularly the invention relates to a trash container which is formed by a layer of material affixed to a package of consumer or industrial goods.

CROSS-REFERENCE

None.

STATEMENT REGARDING THE USE OF FEDERAL FUNDS

No federal funding, direct or indirect, has been utilized in conjunction with the development of the present invention.

STATEMENT REGARDING MICROFICHE RECORDS

No microfiche records are used in the application submitted for the present invention.

PUBLICATION

The invention disclosed in this application was the subject of an application filed in another country or under a multilateral agreement that requires publication at eighteen months after filing. Pursuant to 35 U.S.C.122(b), this application was published other than in the United States.

PRIOR ART

No prior art can be found which discloses the present invention. Comment is required to understand why this seemingly obvious technology has not been utilized in the past in spite of a long standing need. Historically, trash containers have been considered to be distinct from regular packaging materials and, as such, their form has evolved into a wide diversity of independent bags, sacks and receptacles. The use of both regular packaging materials and trash container to achieve an integrated result is long overdue. Even so simple a method as including a loose trash bag within a container which holds goods, so as to afford a storage means for the trash generated when the goods are unwrapped is unknown. The packaging industry has jealously embraced the need for (1) secure containment, (2) attractive appearance and (3) suitability for given goods as paramount. Trash containment for this commercial sector is, at best, a remote concern.

The following patents are cited as representative of designs or containment means which ignore such a joint functionality and which address only (1) packaging or (2) trash containment; U.S. Pat. D/348, 922, Baxley, G A, an ornamental design for a trash bag system; US Patent Application 2000282755, Kim Bum Kee, a portable trash collector, and; U.S. Pat. No. 7,758,243, Bonke, Douglas D, an elastic drawstring closure means for a plastic liner for a receptacle. All of these are remote from the present invention and none teach the simplicity of the joint functionality described herein.

SUMMARY OF THE INVENTION

The present invention discloses an integrated combination of a package of consumer or industrial goods and a trash container to allow trash which is generated from goods contained within the package to be routinely and immediately disposed of in the trash container. The trash container is formed by a layer of material affixed to the package. The present invention provides a convenient disposal arrangement for the trash generated when some types of consumer and industrial goods are accessed and used.

Current disposal means are separate from packaging means, an arrangement which in many cases is inefficient and inconvenient. This problem is completely resolved by the present invention by integrating the design to encompass both functions. The result is an environmentally desirable combination. Although such a configuration is simple, this very favorable result has not been obvious even though the need has been long standing.

It is an object of the present invention to provide a new configuration for goods by creating a disposal enclosure as part of a package holding goods.

These and other objects an advantages of the present invention will become clear to those skilled in the art in view of the description of the best presently known mode of carrying out the invention and the applicability of the preferred embodiment as described herein and as illustrated in the several figures of the drawings.

BACKGROUND OF THE INVENTION

Figure 1:
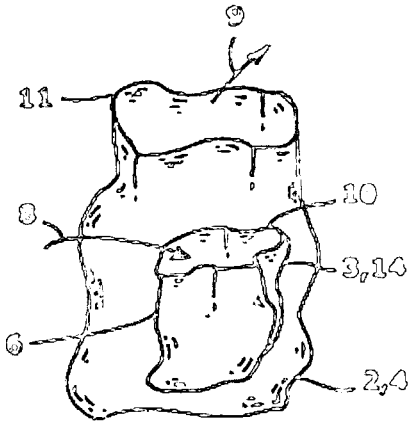
FIG. 1 shows a perspective view of a container with an attached removable bag according to the present invention.

Trash which is generated from packaged goods, as the goods are removed from a container and consumed or used, is currently disposed of in various types of trash enclosures. Currently these trash enclosures are not attached to or part of the containers.

Best Method for Carrying Out the Invention

The best method for carrying out the present invention is as set out below. A container is defined to include, but is not limited to, an enclosure, a flexible enclosure, a plastic enclosure, an envelope and a paper bag. A container is defined to include, but is not limited to, bag, a wooden box, a cardboard box, a metal box, a barrel, a can, a jar and a crate. A lid is defined as a closing or sealing element for a container to include, but is not limited to, one or more flaps of a box or the removable and the hinged end of a barrel, box or can. Trash is defined to include, but is not limited to, nut shells, packaging materials and support materials. Closure means is defined to include, but is not limited to, a drawstring, an elastic rim, a tie, one or more snaps, a flap, a velcro fastner and a ziplock closure. Attachment means is defined to include, but is not limited to, an adhesive, one or more snaps, a velcro fastner, a ziplock fastner and means to bond a surface of a bag to the surface of a container.

To understand the range of applications and the details of implementing the present invention, reference is made to the drawings. Referring particularly to the figures wherein like-referenced numbers have been applied to the like-parts throughout the description as illustrated in the several figures of the drawings. According to the present invention FIG. 2 shows a perspective view of a container 2 and a removable bag 14 attached thereto with attachment means 6 and some trash 3 contained in said bag 14, said trash 3 storable therein through an opening 10 as shown by motion arrow 8, consumer or industrial goods 4 contained in said container 2 and removable through an opening 11 therein as shown by motion arrow 9.

Figure 2:
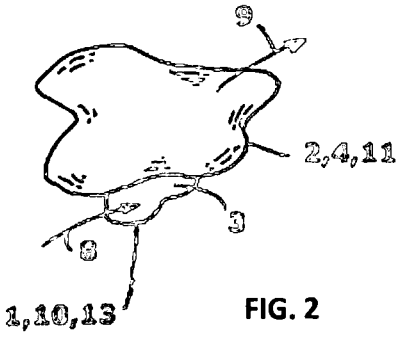
FIGS. 2 and 3 each show a schematic top view of a container with a bag formed by a containing layer and the surface of a container according to the present invention.
Figure 3:
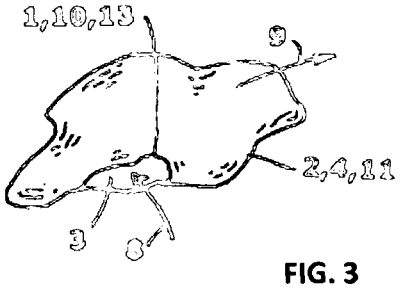
Figure 4:
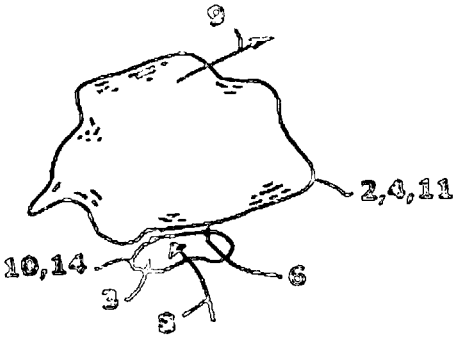
FIGS. 4 and 5 each show a schematic top view of a container with a removable bag attached to a surface of a container.
Figure 5:
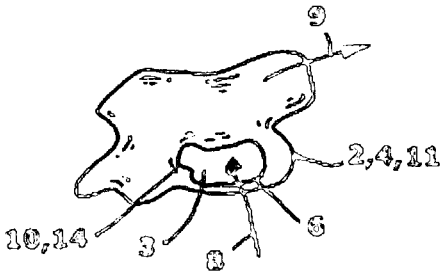

FIGS. 2 and 3 each show a schematic top view of said container 2 with a bag 1 formed by a containing layer 13 and the surface of said container 2 according to the present invention. FIG. 2 shows said bag 1 formed as a portion of the interior of said container 2. FIG. 3 shows said bag 1 formed as a portion of the interior of said container 2. FIGS. 4 and 5 each show a schematic top view of said container 2 with said removable bag 14 attached to a surface of said container 2 with an attachment means 6. FIG. 4 shows attachment of said bag 14 to the exterior of said container 2 and FIG. 5 shows attachment of said bag 14 to the interior of said container 2.

Figure 6:
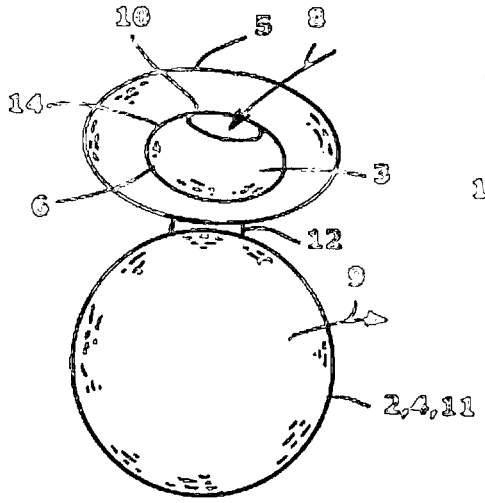
FIG. 6 shows a schematic top view of a container having a lid secured to the top edge of a container with a hinge, a removable bag affixed to the interior of the lid.
Figure 7:
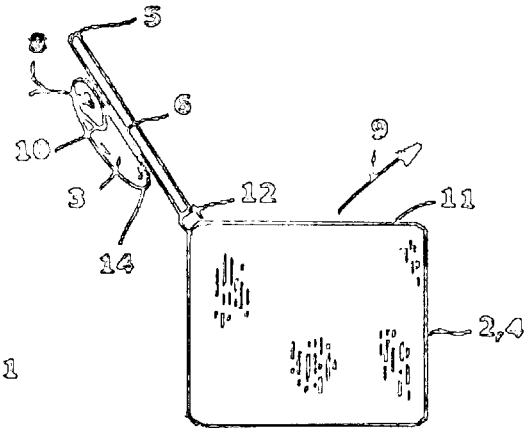
FIG. 7 shows a schematic side view of a container having a lid secured to the top edge of the container with a hinge, a removable bag affixed to the exterior of the lid.

FIG. 6 shows a schematic top view of said container 2 having a lid 5 secured to the top edge of said container 2 by a hinge 12, said removable bag 14 affixed to the interior of said lid 5 with said attachment means 6. FIG. 7 shows a schematic side view of said container 2 having said lid 5 secured to the top edge of said container 2 with said hinge 12, said removable bag 14 affixed to the exterior of said lid 5 with said attachment means 6.

Figure 8:
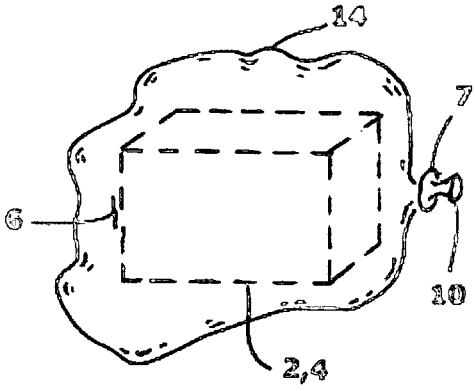
FIG. 8 shows a perspective view of a container enclosed by a bag.
Figure 9:
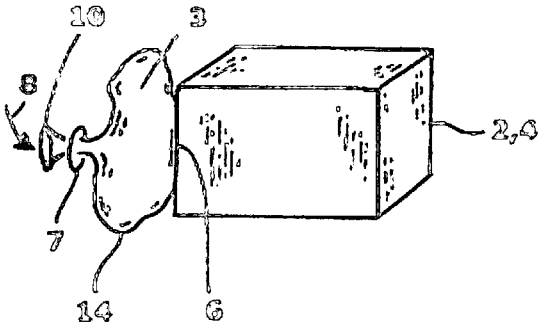
FIG. 9 shows a perspective view of a container with a bag attached to the side of a container.

FIG 8. shows a perspective schematic view of said container 2 enclosed by said bag 14, said bag 14 attached to said container 2 with said attachment means 6. FIG. 9 shows a perspective view of said container 2 as in FIG. 8, but with said container 2 uncovered and with said trash 3 contained in said bag 14. FIGS. 8 and 9 show a closure means 7 to close said bag 14.

The best mode for carrying out the present invention is further disclosed herein below. A trash storage means is defined to be the functional equivalent of a packaging configuration. Said packaging configuration comprising said first container 1,14 affixed by said attachment means 6 to a surface of said second container 2, said consumer or industrial goods 4 containable in said second container 2, said first opening 10 in said first container 1,14, said second opening 11 in said second container 2, whereby removal of said consumer or industrial goods 4 through said second opening 11 and subsequent consumption or use thereof generates said trash 3, said trash 3 containable within said first container 1,14 as shown in FIGS. 1, 2, 3, 4, 5, 6, 7, 9.

A packaging configuration comprising said bag 1,14 and said second container 2 with said attachment means 6 there between being (a) temporary, whereby said containers 1,14 can be separated or (b) said containers 1,14 are permanently affixed as shown respectively in FIGS. 1, 4, 5, 6, 7, 8, 9 and in FIGS. 2, 3. A packaging configuration comprising said first container 1, 14 attached to a surface of said second container 2, said surface (a) internal to or (b) external to said second container 2 as shown respectively in FIGS. 3, 5, 6 and in FIGS. 1, 2, 4, 7, 8, 9.

A packaging configuration with said second container 2 further comprising a lid 5, said lid 5 rotatably affixed to an edge of said opening 11 in said second container 2 whereby said second container 2 is enclosable with said lid 5, said first container 1 affixed to one side of said lid 5 as shown in FIGS. 6, 7. A packaging configuration comprising said first container 1,14 affixed to said second container 2, said opening 10 in said first container 1,14 further comprising said closure means 7 to close said first opening 10 as shown in FIGS. 8, 9.

A packaging configuration comprising said first container 1 and said second container 2, said consumer or industrial goods 4 containable in said second container 2, said first container 1 comprising said layer of material 13 affixed along (a) all of its periphery to a surface of said second container 2, said opening 10 in and central to said layer 13, or (b) a portion of its periphery to a surface of said second container 2, said first opening 10 at and along an unaffixed edge of said periphery of said layer 13, whereby said layer 13 and said surface of said second container 2 form a volume, accessable through said opening 10, whereby said trash 3 is storable therein.

In another embodiment of the present invention, said bag 14 is initially inverted and used to encompass and thereby protect said container 2 whereby when said bag 14 is opened, access to said container 2 is then afforded and said bag 14 is then used to contain said trash 3 generated as the contents of said container 2 are consumed or used as shown in FIGS. 8 and 9.

Those skilled in the art will readily observe that numerous other modifications and alterations may be made without departing from the spirit and scope of the invention. For example, the baffles can be comprised of structures which are not flat and/or they can be made of different materials such as porous or have large effective surface areas to equal effect. A new functionality and convenience has been realized by the combination provided by the present invention. A person who is skilled in the required art for this invention is anyone who has used a container for goods and a trash bag. The above disclosure is not intended as limiting and the appended claims are to be interpreted as encompassing the entire scope of the invention.

Reference Numbers

| Number | Description |
|---|---|
| 1. | Bag |
| 2. | Container |
| 3. | Trash |
| 4. | Goods |
| 5. | Lid |
| 6. | Attachment means |
| 7. | Closure means |
| 8. | Motion arrow, in |
| 9. | Motion arrow, out |
| 10. | Opening, bag |
| 11. | Opening, container |
| 12. | Hinge |
| 13. | Containing layer |
| 14. | Removable bag |

What is claimed is:

1. A method for storing trash comprising the steps of: providing at least one first container and providing an opening therein, and (A)(1) providing a unitary second container, containing consumer or industrial goods in said second container, constituting said second container, in part or in whole, as packaging materials, constituting said goods with packaging materials and/or disposable portions, affixing said at least one first container to said second container by permanent or detachable means, providing that detachment renders reattachment thereof impossible or impractical, removing said goods from said second container and using or consuming said goods;

(a) said packaging materials, in part of in whole, constituting trash, and/or (b) said discardable portions of said goods constituting discardable trash, and placing said trash and/or said discardable trash in said at least one first container, or (2) providing a plenary container, providing at least one unitary third container, constituting said at least one third container, in part or in whole, as packaging materials, housing said at least one third container in said plenary container, containing said consumer or industrial goods in said at least one third container, constituting said goods with packaging materials and/or disposable portions, affixing said at least one first container to said at least one third container and/or to said plenary container by permanent or detachable means, providing that detaching renders reattaching thereof impossible or impractical, removing said goods from said at least one third container and using or consuming said goods;

(a) said packaging materials, in part of in whole, constituting trash, and/or (b) said discardable portions of said goods constituting discardable trash, and placing said trash and/or said discardable trash in said at least one first container, and (B) providing said at least one first container is by further;

providing a layer of material, affixing said layer to a surface of (1) said second container or (2) said at least one third container or (3) said plenary container along:

(a) the periphery of said layer, and centrally providing an opening in said layer, or (b) a portion of the periphery of said layer and providing an opening at and along an unaffixed edge of said periphery, and placing said trash and/or said discardable trash between said layer and said surface.

2. A method for storing trash as in claim 1 wherein the step of providing said goods is by providing unshelled edible nuts.

* * * * *